United States Patent [19]

Woffendin

[11] Patent Number: 4,592,223

[45] Date of Patent: Jun. 3, 1986

[54] WIRE FORMING APPARATUS

[75] Inventor: Arnold Woffendin, Colne, England

[73] Assignee: Silentnight Holdings PLC, Colne, England

[21] Appl. No.: 658,136

[22] Filed: Oct. 5, 1984

[30] Foreign Application Priority Data

Oct. 12, 1983 [GB] United Kingdom ..... 8327306

[51] Int. Cl.[4] ..... B21F 3/04; B21F 45/00

[52] U.S. Cl. ..... 72/142; 72/145; 140/71 R

[58] Field of Search ..... 72/135, 137, 138, 139, 72/140, 142, 143, 145; 140/71 R, 102, 103, 105

[56] References Cited

U.S. PATENT DOCUMENTS

| | | | |
|---|---|---|---|
| 112,868 | 3/1871 | Van Vleck | 72/137 |
| 484,426 | 10/1892 | Hartley | 72/137 |
| 904,563 | 11/1908 | Rau | 140/71 R |
| 3,872,896 | 3/1975 | Yoshimura | 140/71 R |
| 3,993,106 | 11/1976 | Yokota | 140/71 R |
| 4,471,819 | 9/1984 | Nihashi | 140/71 R |

*Primary Examiner*—E. Michael Combs

*Attorney, Agent, or Firm*—Woodard, Weikart, Emhardt & Naughton

[57] ABSTRACT

Wire forming apparatus has a pair of rotary dies movable together and apart on a rectilinear path. The dies are adapted to hold a length of wire at opposite ends thereof such that on contra-rotation the dies approach each other while deforming said ends into coils.

9 Claims, 14 Drawing Figures

WIRE FORMING APPARATUS

This invention relates to wire forming apparatus.

Recently the need has arisen to manufacture double springs as disclosed for example in our European Patent Application No. 83 303419.2 which relates to a box spring assembly comprising a plurality of deck elements each formed from a single length of wire having an elongate central section terminating in curved sections extending at least in some elements into spring legs.

It is an object of the present invention to provide wire forming apparatus capable of forming the opposite ends of a length of wire into respective coil formations.

According to the present invention there is provided wire forming apparatus comprising a pair of rotary dies movable together and apart on a rectilinear path and adapted to hold a length of wire at opposite ends thereof such that on contrarotation the dies approach each other while forming said ends into coils.

The invention will now be further described by way of example only, with reference to the accompanying drawings, in which:

FIG. 1 and the insets a to e show one embodiment of wire forming apparatus according to the invention and details of parts thereof indicated by the arrows;

FIGS. 5*a–e* show different stages in the bending operation.

Figures 1, 1A, 1B, 1C, 1D, 1E:
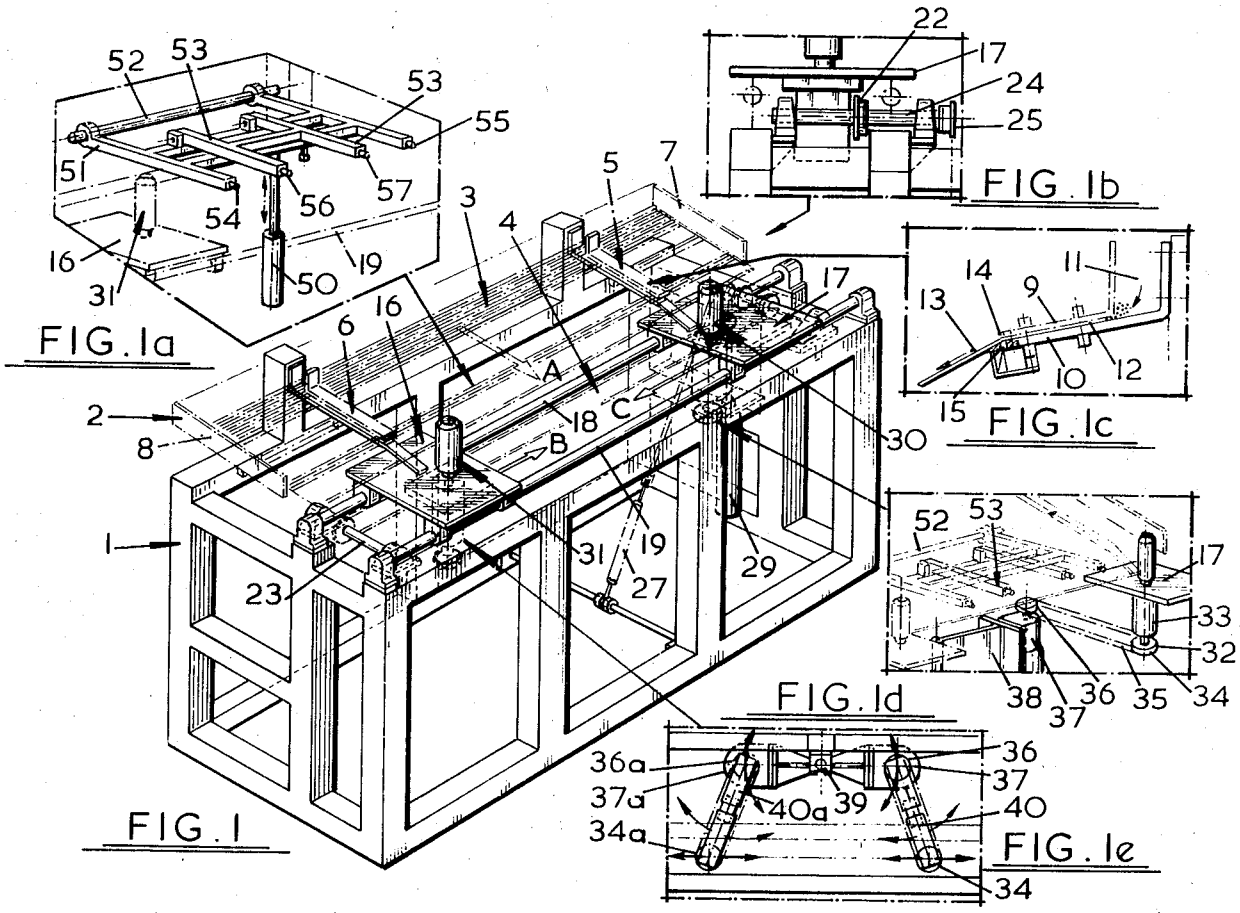

The wire forming apparatus comprises a frame 1 supporting a wire feeder 2 for advancing wire rod sections 3 to a deforming mechanism 4. As shown in FIG. 1 and inset 1*c*, the wire feeder 2 has two horizontally spaced guides 5, 6 flanked by lateral walls 7, 8. The guide 5 has an upper guide strip 9 spacedly arranged above a lower guide strip 10. The rear ends of the two guide strips 9, 10 are turned upwardly and widely spaced to define a hopper formation 11. In front of the hopper formation 11 the guide strips 9, 10 define a chute 12 having a width only slightly greater than the thickness of the wire sections 3. The front end of the chute 12 is closed by a ramp 13 extending to the deforming mechanism 4. The upper guide strip 9 ends short of the ramp 13 to leave a slot 14 through which the leading wire section 3 can be ejected by an ejector (not shown) slidable in a bore 15.

The guide 6 is constructed in the same way as the guide 5 and corresponding parts are designated by the same numerals with suffix a. In use, a supply of wire sections 3 is loaded into the hopper formations 11, 11*a*. The axial position of the wire sections 3 is defined by the lateral walls 7, 8. A single layer of wire sections 3 rolls down the chutes 12, 12*a* under the influence of gravity. The leading section 3 is lifted onto the ramps 13, 13*a* by the ejectors and rolls into a defined location on the deforming mechanism 4. The general feed direction of the wire sections 3 is indicated by the arrow A.

Figure 2:
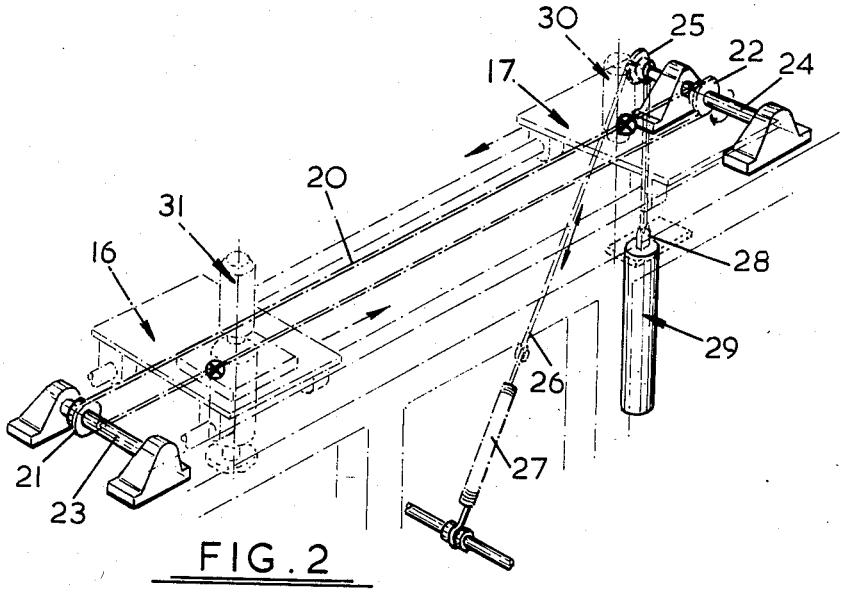
FIG. 2 shows part of the embodiment of FIG. 1 in greater detail.
Figure 5A:
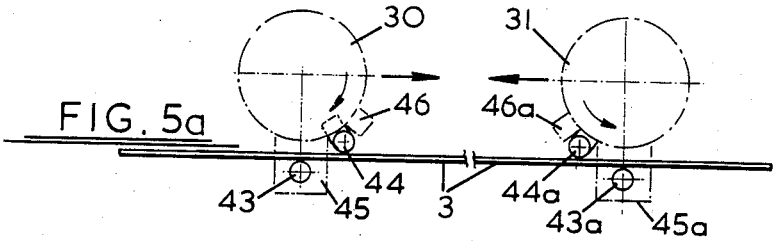
Figure 5B:
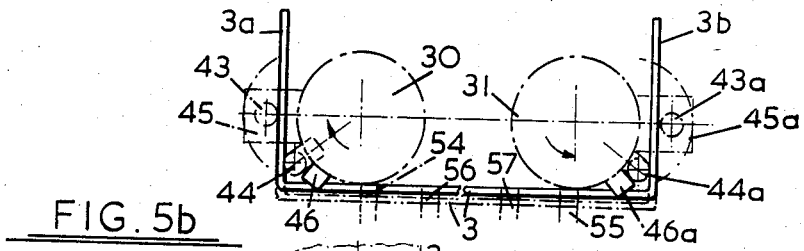
Figure 5C:
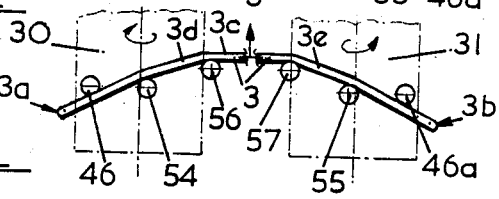
Figure 3:
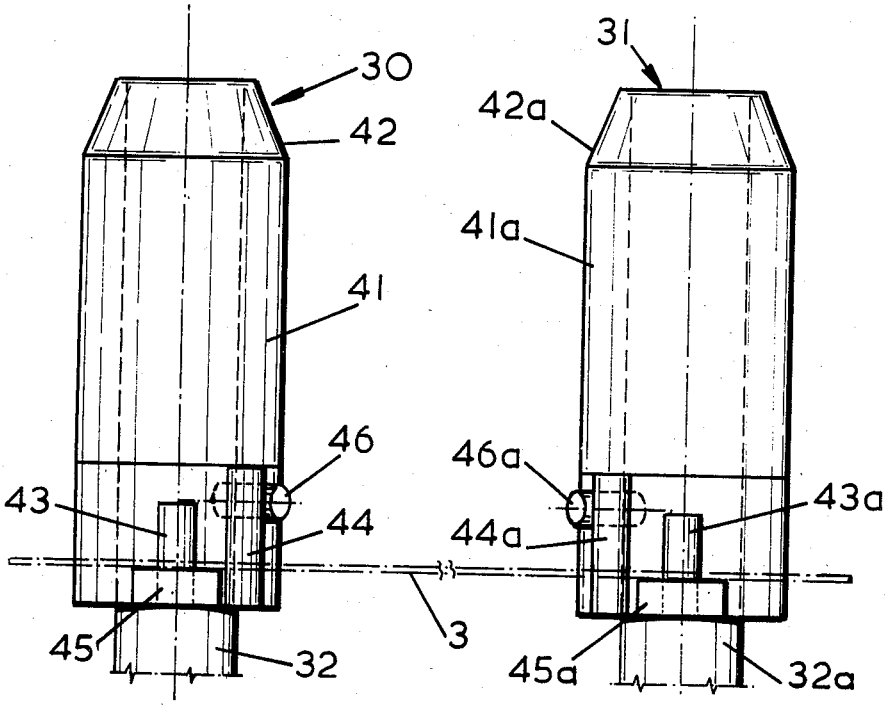
FIG. 3 is a front elevation of the apparatus showing only the bending dies and a wire section about to be deformed thereby.
Figure 4:
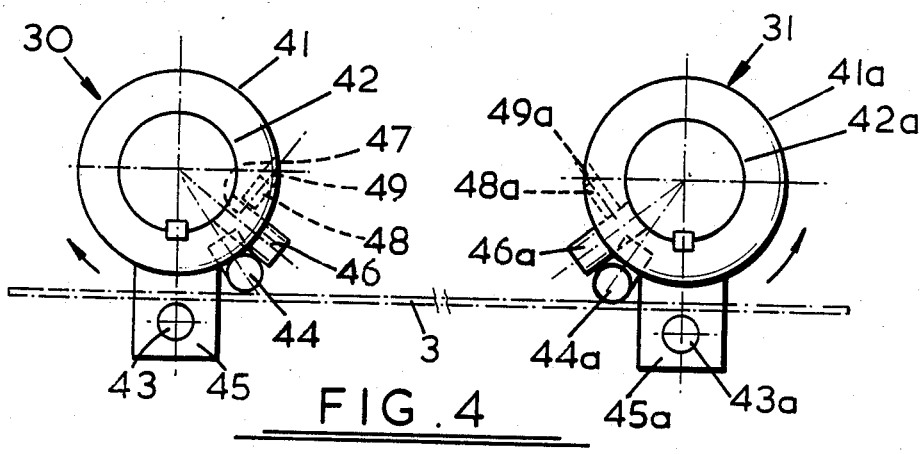
FIG. 4 is a plan view corresponding to FIG. 3.
Figure 5D:
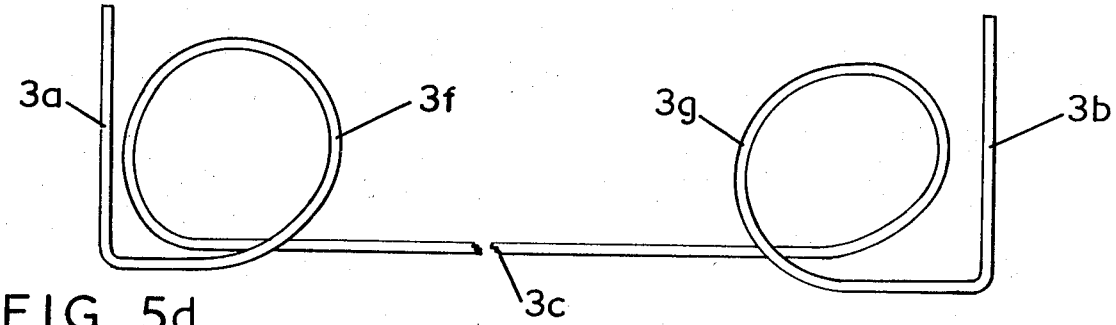
Figure 5E:
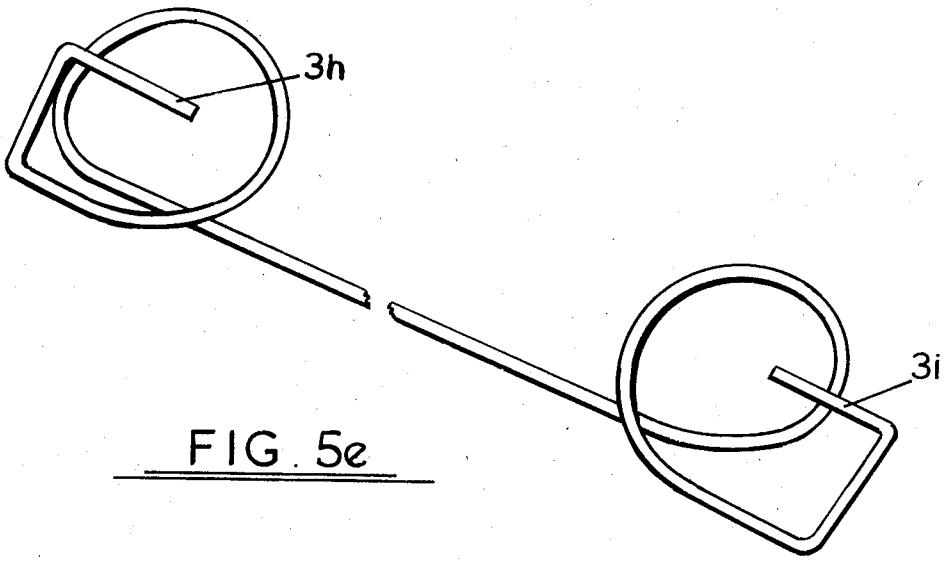

The function of the deforming mechanism 4 is to bend a straight wire section 3 as shown in FIG. 5*a* into the partly completed double spring shown in FIG. 5*d*. This involves bending the wire in both horizontal and vertical directions. Horizontal bending is achieved by the mechanism at the front of th frame 1. This comprises carriages 16, 17 slidable together in the directions of arrows B, C on parallel rails 18, 19. Synchronised movement of the carriages is achieved by a chain 20 to which each carriage is fixed at the points marked in FIG. 2. The chain 20 runs on sprockets 21, 22 on shafts 23, 24. The shaft 24 is extended rearwardly as shown in FIG. 1*b* and 2 to receive a further sprocket 25 which is engaged by a chain 26 one end of which is anchored to a frame member via a coil spring 27 and the other end of which is fixed to the plunger 28 of a fluid pressure operated ram member 29. When the carriages 16, 17 move together the chain 20 causes rotation of the shaft 24 and hence the sprocket 25 thus lifting the plunger 28 via the chain 26, the slack being absorbed by the spring 27. In order to move the carriages 16, 17 apart the ram member 29 is actuated to retract the plunger 28 thereby reversing the rotation of the shaft 24 and the direction of travel of the chain 26. Alternatively, the chain 26, spring 27 and ram 29 may be replaced by a weight which is suspended from the shaft 24 so as to be lifted when the carriages 16, 17 move together. When the formed wire section is removed from the dies the weight falls to move the carriages apart. Each carriage 16, 17 mounts a generally cylindrical steel die 30, 31 rotatable about a vertical axis. Since both dies and their drive mechanisms are similarly constructed only the die 30 and its associated drive mechanism will be described, the corresponding parts of the other die 31 and its drive mechanism being designated by the same reference numerals with the suffix a. The die 30 has a drive shaft 32 which extends downwardly from the carriage 17 through a bearing support 33 and terminates in a drive sprocket 34 (FIG. 1*d*). A drive chain 35 connects the sprocket 34 with a drive sprocket 36 on the output shaft of an electric drive motor 37 which is mounted on a carrier 38 pivotal about a vertical axis 39 common to the other carrier 38*a* of the motor 37*a* (FIG. 1*a*). The distance between the drive sprockets 34, 36 is fixed by a telescopically adjustable bar 40. This arrangement of pivotally mounted motor and rigid interconnection between the drive sprockets enables the drive sprockets 34, 34*a* to travel on a rectilinear path while pivoting about the other drive sprockets 36, 36*a* which are themselves caused to pivot about the common axis 39 as indicated by the arrows in FIG. 1*e*.

The upper ends of the drive shafts 32, 32*a* are fixed to the dies 30, 31. As already mentioned, only the die 30 will be described, corresponding parts on the other die 31 being designated by the same reference numerals with the suffix a. The die 30 has a cylindrical body 41 with a frusto-conical upper end 42. At the lower end of the die 30 are two radially and circumferentially spaced pillars 43, 44. The piller 43 is spaced from the body 41 on a radially projecting platform 45 and the longer pillar 44 is welded directly to the body 41. The axes of the pillars 43, 44 are parallel to the axis of rotation of the die 30. At the opposite side of the pillar 44 from the pillar 43 a cylindrical stop 46 projects from the body 41 at a level between the upper ends of the two pillars 43, 44. This stop 46 is fixed in a radial bore 47 in the die body 41 by means of a clamping screw 48 in the side bore 49.

Vertical bending of the wire is achieved by the mechanism shown in inset 1*a* but omitted from FIG. 1 for the sake of clarity. It comprises a double-acting cylinder 50 arranged to pivot an H-frame 51 about a fixed member 52. Mounted on the H-frame 51 with adjustable spacing therefrom is a fork 53. Wire engaging projections 54, 55 extend from the front ends of the side members of the H-frame 51 and the fork 53 has similar projections 56, 57 in the same vertical plane as the projections 54, 55.

A wire section 3 fed to the deforming mechanism 4 rolls down the ramps 13, 13*a* onto the die platforms 45, 45*a* between the pillars 43, 44 of the die 30 adjacent one end of the wire and likewise at the other end of the wire (FIG. 5*a*). The carriages 16, 17 are spaced at the maximum distance apart as shown in FIG. 1. The drive motors 37, 37*a* are started to rotate the dies 30, 31 in opposite directions as indicated by the arrows in FIG. 5*a*. The pillars 43, 44 and 43*a*, and 44*a* and the fixed stops 5 and 5' on the machine frame trap the wire section 3 at the two locations where it is desired to form a right-angle bend. Since the wire section 3 is not free to move because it is being pulled in opposite directions, the dies 30, 31 can only rotate by moving towards each other with the carriages 16, 17. The end of the first stage of the bending operation is shown in FIG. 5*b*. The dies 30, 31 are slightly closer together, the ends 3*a*, 3*b* of the wire have been bent at right-angles to the central section 3*c*, and the stops 46, 46*a* overlie the wire in the vicinity of the bends.

The vertical bending mechanism is now operated. The cylinder 50 lifts the H-frame through a predetermined distance so that the projections 54, 55 of the H-frame 51 and the projections 56, 57 of the fork 53 raise the wire into the position shown in FIG. 5*c*, upward movement of the ends of the wire being prevented by the stops 46, 46*a*. The vertical spacing between the H-frame 51 and the fork 53, and hence between the projections 54, 55 on the one hand and the projections 56, 57 on the other hand, determines the angle of inclination of the wire portions 3*d*, 3*e* adjacent the dies 30, 31. As rotation of the dies 30, 31 continues, the carriages 16, 17 continue to move together and the wire portions 3*d*, 3*e* wrap round the die bodies 41, 41*a* to form spiral loops 3*f*, 3*g* as shown in FIG. 5*d*. The pitch of the spiral and hence the height of the coil is determined by the inclination of the wire portions 3*d*, 3*e* in FIG. 5*c* and can therefore be varied by changing the spacing of the fork 53 with respect to the frame 51.

The wire section 3 is now lifted off the dies 30, 31 and subjected to a further bending operation to turn in the ends 3*h*, 3*i* and complete the double spring element described in our aforesaid European Patent Application. As soon as the wire secion 3 has been removed from the dies 30, 31 the carriages 16, 17 are free to move apart to the starting position under the influence of the return mechanism including the ram member 29. The operations are then repeated with another wire section 3.

What is claimed is:

1. Wire forming apparatus comprising a pair of rotary dies movable together and apart on a rectilinear path and adapted to hold a length of wire at opposite ends thereof such that on contra-rotation the dies approach each other while deforming said ends into coils, wherein lifting means is provided for continuously lifting a central section of the wire in a lifting direction parallel to the axes of rotation of the dies during approach movement of the dies so as to control the angle of inclination of the wire adjacent the dies with respect to the axes of rotation thereof, thereby imparting a desired pitch and height to said coils.

2. Apparatus as claimed in claim 1, wherein said lifting means comprises fixed stroke drive means connected to a first lifting member carrying a second lifting member which is adjustable with respect to the first lifting member in the lifting direction so as to vary the inclination of the wire adjacent the dies, and thereby, said pitch.

3. Apparatus as claimed in claim 1 or 2, wherein said dies have respective detents for restraining upward movement of said wire under the influence of said lifting means.

4. Apparatus as claimed in claim 1, wherein each die has two projections which are radially and angularly spaced with respect to the axis of rotation so as to engage the wire from opposite sides thereof and impart a bending force thereto on rotation of the die.

5. Apparatus as claimed in claim 4, wherein the connection of the radially outer projection to the body of the die provides a support for the wire at the start of the coiling operation.

6. Apparatus as claimed in claim 1, wherein the dies are cylindrical in order to form spiral coils.

7. Apparatus as claimed in claim 1, wherein each die is driven by a respective drive motor and chain transmission, the two motors being mounted for pivotal movement about a common axis under the influence in each case of a rigid connecting arm pivotally joined to the motor and the die.

8. Apparatus as claimed in claim 1, further comprising means for automatically returning the dies to their starting position after removal of a finished wire.

9. Apparatus as claimed in claim 1, wherein feed means is provided for feeding successive lengths of wires to the dies, said feed means comprising hopper means for receiving a supply of said wire lengths, inclined chute means for feeding a single layer stream of said lengths from the hopper towards the dies, and separating means for separating the leading length of wire from said stream for delivery to said dies.

* * * * *